United States Patent [19]

Wilkes

[11] 4,031,796

[45] June 28, 1977

[54] SOLENOID MOUNTING ASSEMBLY FOR MUSICAL KEYBOARD

[75] Inventor: Thomas Jewel Wilkes, Lewisburg, Tenn.

[73] Assignee: Teledyne, Inc., Los Angeles, Calif.

[22] Filed: Apr. 28, 1976

[21] Appl. No.: 681,095

[52] U.S. Cl. ..... 84/20; 84/107; 84/246; 248/222.1

[51] Int. Cl.[2] ..... G10C 3/20

[58] Field of Search ..... 84/16–23, 84/107, 244–246; 248/73, 222.1, 298

[56] References Cited

UNITED STATES PATENTS

| | | | |
|---|---|---|---|
| 2,291,966 | 8/1942 | Joseph | 248/298 X |
| 3,126,783 | 3/1964 | Von Gunten | 84/19 X |
| 3,126,784 | 3/1964 | Wood | 84/19 X |
| 3,581,255 | 5/1971 | Cannon et al. | 84/107 X |
| 3,634,877 | 1/1972 | Cannon et al. | 84/19 X |

*Primary Examiner*—Lawrence R. Franklin
*Attorney, Agent, or Firm*—Jim Zegeer

[57] ABSTRACT

This is disclosed a mounting assembly for mounting a large number of solenoids in a keyboard actuated musical instrument. An extruded mounting plate or rack has locking slots formed in a surface thereof and cooperating grooves formed in a protrusion or rib. Each solenoid has a frame assembly with oppositely extending flanges, one flange being received in a groove in the projection or rib and the other flange having an off-set screw engaged with a threaded element or fastener in the slots of the rack or bar.

7 Claims, 7 Drawing Figures

SOLENOID MOUNTING ASSEMBLY FOR MUSICAL KEYBOARD

BACKGROUND OF THE INVENTION

There have been a number of electronically actuated keyboard musical instruments wherein the actuation of the individual keys of the keyboard is accomplished by the action of an individual solenoid. In the past, these solenoids have been mounted in rack assemblies but these assemblies have been somewhat complex, with the individual solenoids being difficult to remove and/or adjust. A typical mounting rack for electrical solenoids of the prior art is illustrated in Von Gunten U.S. Pat. No. 3,405,584, Del Castillo U.S. Pat. No. 3,709,085, and Severy et al U.S. Pat. No. 1,196,401; there are, of course, a number of other disclosures, these being merely repesentative examples. It will be appreciated that when the musical instrument is a player piano, there are large numbers of individual keys to be individually actuated, without interference with one another and, at the same time, each must be relatively accurately located. It is also necessary that the solenoids can be assembled for attachment to existing pianos and accommodated therewith in kit form. The prior art systems are not adequate and are too expensive. Accordingly, the object of the present invention is to provide a solenoid mounting assembly for electronic player pianos and other keyboard type instruments which can be mounted in a new or existing piano with the solenoids easily aligned with the individual keys, and wherein the solenoids can be removed for replacement and/or adjustment and in which the solenoids are prevented from scissoring while they are being installed.

The invention provides a solution to the above-mentioned problems by providing an extruded mounting rack having screw slots formed therein, and in a preferred embodiment, there are two screw slots at opposite ends of the extrusion and a central rib carrying a groove therein. Each of the solenoids is provided with a mounting bracket which as a pair of laterally extending flanges being frictionally received in the groove formed in the central rib and the other flange having a nut passing therethrough which is secured in the screw slot.

BRIEF DESCRIPTION OF THE DRAWINGS

The above and other objects, advantages, and features of the invention will become more apparent from the following specification taken in conjunction with the accompanying drawings wherein:

As shown in FIG. 1, a typical action assembly of a piano keyboard includes a key bed 10, on which are mounted front rail 11, balance rail 12, and back rail 13.

Figure 1:
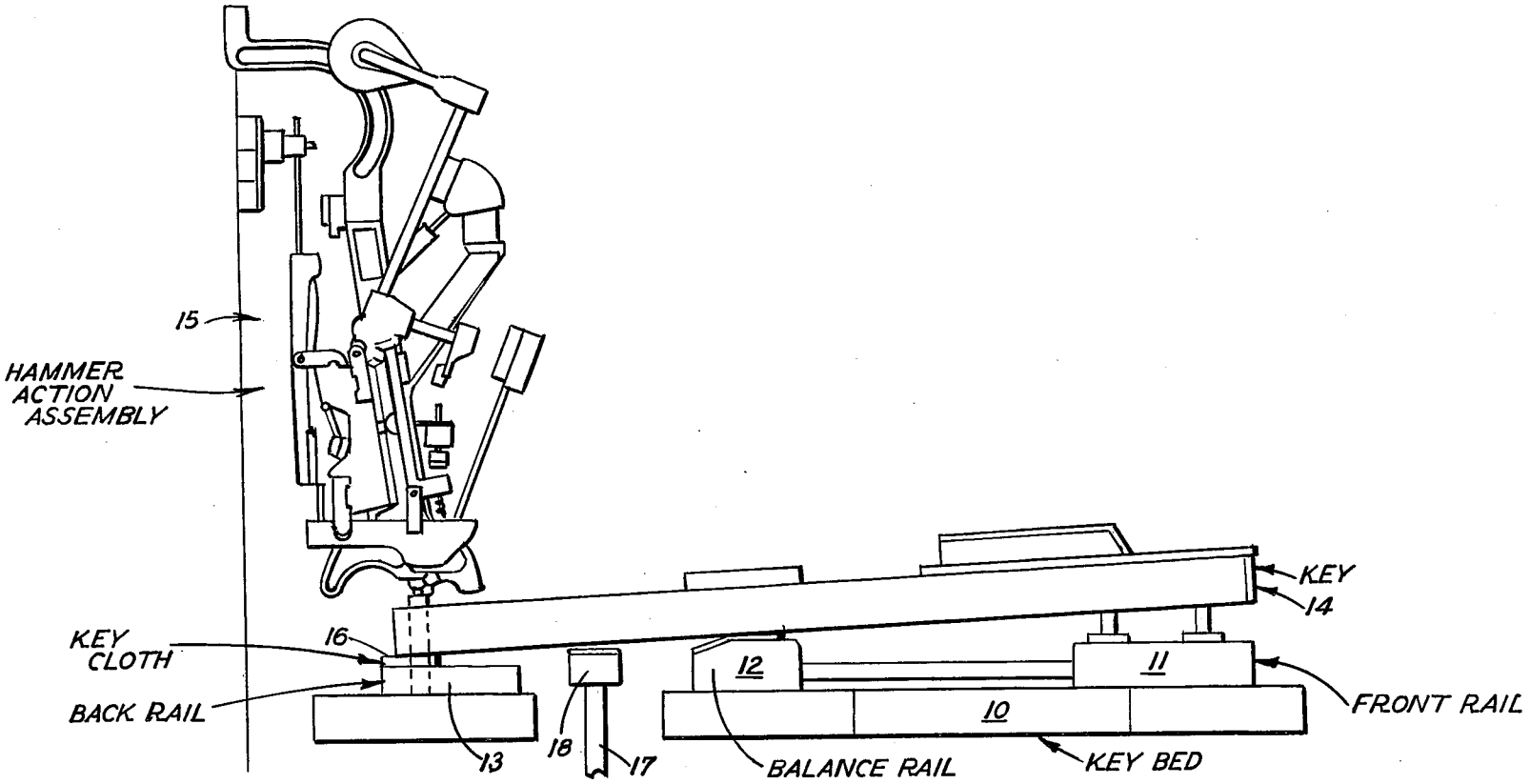
FIG. 1 is a drawing of a typical action assembly for an 88 key piano.

Piano keys 14 are balanced on balance rail 12 and when depressed pivot on balance rail 12 to actuate the hammer action assembly designated generally as 15. The piano keys normally rest on the key cloth 16 on the back rail 13. If the piano is to be used for recording key switch actuations, then a key switch assembly may be mounted beneath key 14 and between the key bed 10. A solenoid plunger 17 having its key engage or strike tip 18 is shown in its generally aligned position with the key between the key cloth resting point and the balance rail. Thus, movement of the solenoid plunger 17 to engage the key 14 serves to actuate the hammer action assembly in the same way that the manual depression of the key 14 would actuate same.

Figure 2:
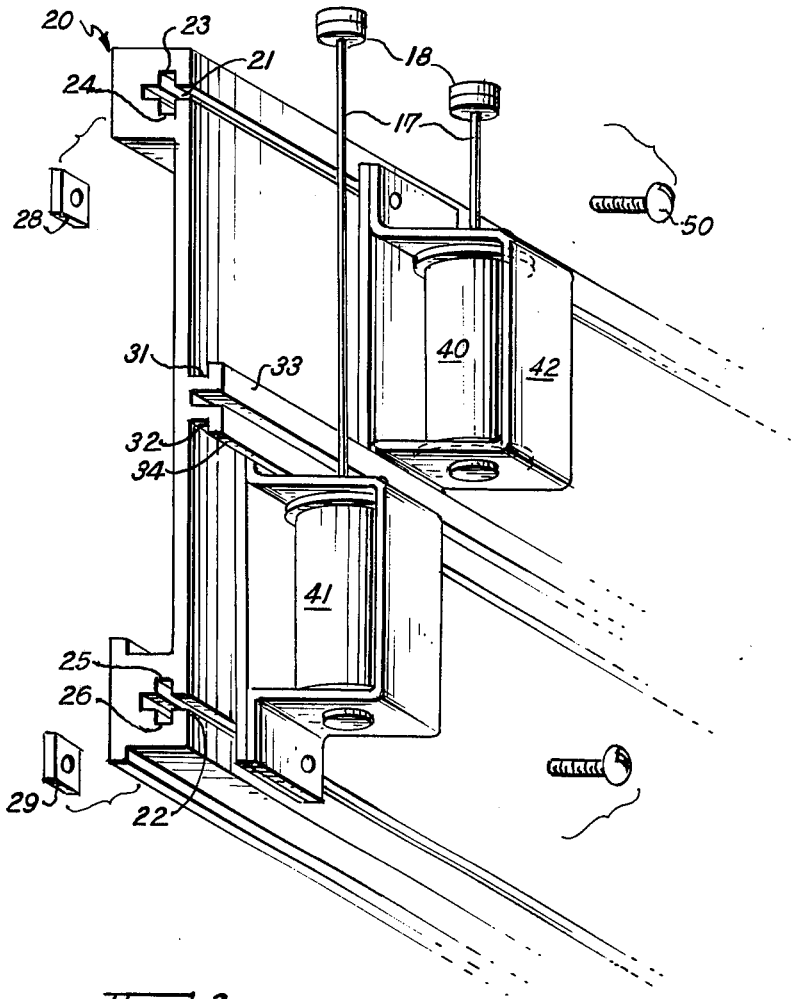
FIG. 2 is an isometric view of the mounting rack of the invention.

The invention is best seen in the isometric perspective view of FIG. 2 in which the solenoid mounting assembly includes an extruded metal mounting bar member or rack 20. Rack 20 has a pair of locking nut slots 21 and 22, each of which has grooved or slotted interior walls 23 and 24 in slot 21, and 25 and 26 in slot 22 which receive nuts 28 and 29, there being one nut for each solenoid assembly. In the center of the extruded rack member 20 is a pair of flange receiving grooves 31 and 32 formed on central protrusion or ribs 33 and 34, respectively. It will be appreciated that ribs 33 and 34 may be a single T-shaped element integrally extruded with plate 20 or may be formed separately and screw fastened or otherwise secured to the center of rack plate 20. In the preferred embodiment, it is highly desirable that the extruded configuration be utilized since it does eliminate some of the fabrication and large numbers of the rack may be made at relatively low cost.

Figure 5:
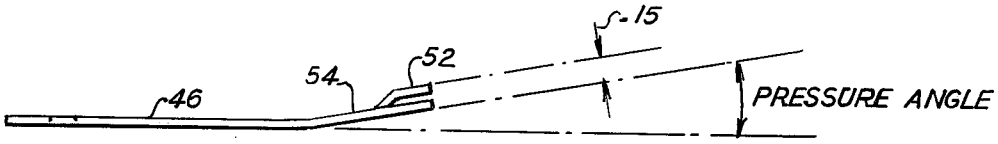
FIG. 5 is a side elevational view of the back plate of the solenoid showing the locking tongue and pressure angle therein.
Figure 3B:
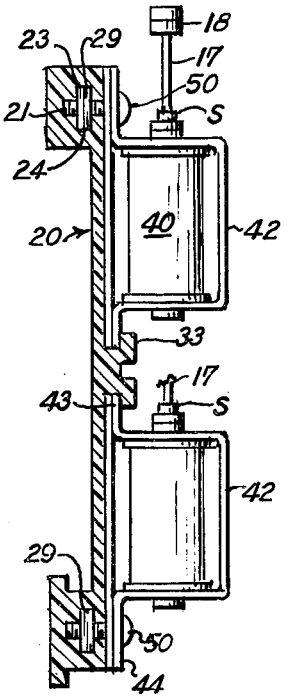
FIG. 3 *a* is a top plan view thereof and FIG. 3 *b* is a cross-sectional view taken on lines B—B of FIG. 3 *a*.
Figure 3A:
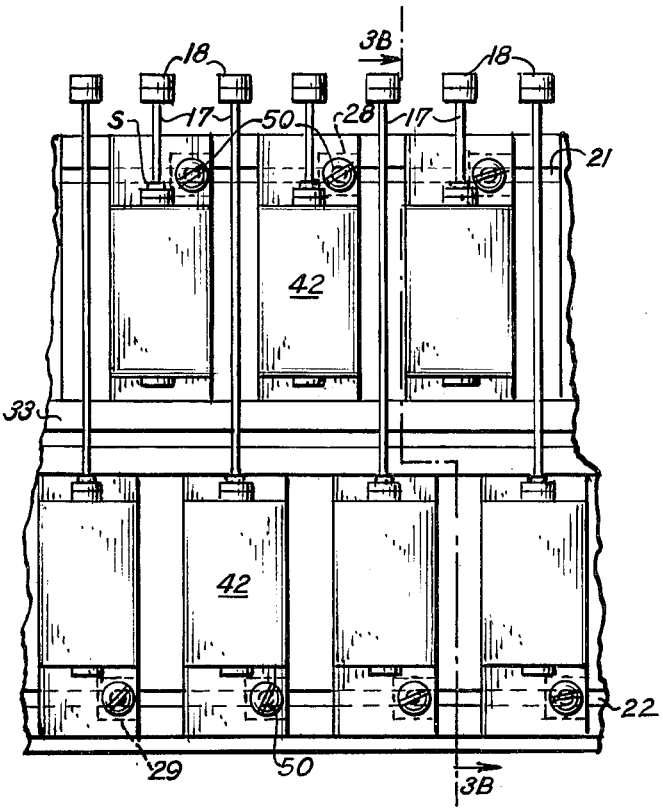
Figure 4:
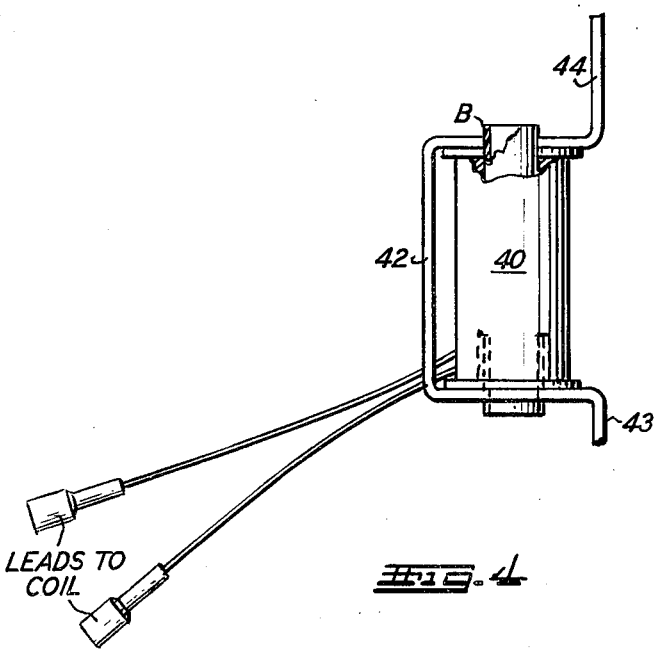
FIG. 4 is a partially cut away side view of the solenoid with plunger removed.
Figure 6:
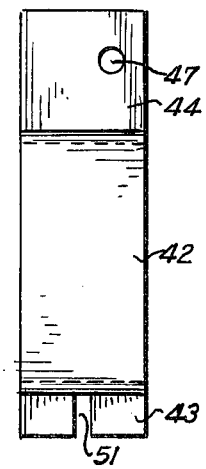
FIG. 6. is a top elevational view of the solenoid frame.

The solenoids 40 and 41 each have a mounting bracket or assembly shown in detail in FIGS. 4, 5 and 6. Each of the solenoids 40, 41 carries a separate plunger or rod 17 which is secured to the solenoid armature per se via stop member 5 with the lower solenoid 41 having a longer arm or plunger 17. The armatures of the solenoids freely slide in low friction bushings, such bushings are phenolic paper base Grade XX Type PPG, made to FED-LP-509 specifications. Of course, other low friction materials may be used, such as TEFLON. Each of the ends 18 of the solenoids is positioned the same distance beneath the respective keys of a keyboard and each solenoid is free to move upwardly, while a stop member establishes the rest position. Each of the solenoids has a frame 42 (FIG. 4) which has a short flange 43 and a long flange 44. A backing plate 46, shown in detail in FIG. 5, is to the back of U-shaped bracket 42 against the upper and lower flanges. Referring now to FIGS. 4 and 5, it will be noted that flange 44 has a screw hole 47 formed therein in alignment with screw hold 48 of the back plate 46. As shown in FIGS. 2 and 3, screws 50 pass through these holes 47 and 48 to engage with nut 28. It will be appreciated that instead of separate nuts 28 in slots 23 and 24, and nuts 29 in slots 25 and 26, the side walls of screw slots 21 and 22 may themselves be provided with ribs forming threads so that the threads on screw 50 merely threadably engage these side walls.

The lower flange 43 of bracket 42 is provided with a positioning and locking slot 51. A locking tongue 52, which is off-set from deflected end 54 of back plate 46, prevents the solenoids from a scissoring effect while they are being installed on the mounting bar. The locking tongue 52 and the angle (about 100°) shown in FIG. 5 causes a constant spring pressure to be applied to the solenoid which allows a single screw adaptation from the solenoid frame to the mounting bar. The lower flange assembly is received in the grooves 31 and 32, respectively, for the upper and lower solenoid assemblies 40 and 41 as shown in FIG. 2. The side elevational view of FIG. 3*a* illustrates the locking arrangement.

It will now be seen how the invention accomplishes its various objects and the various advantages of the invention will likewise be apparent. While the invention has been described and illustrated herein by reference to certain preferred embodiments, it is to be understood that various changes and modifications may be made in the invention by those skilled in the art, without departing from the inventive concept, the scope of which is to be determined by the appended claims.

I claim:

1. In a keyboard musical instrument, a solenoid mounting member for a plurality of solenoid operated key actuating assemblies, each key actuating assembly having a mounting bracket which includes a back plate, said solenoid mounting member being constituted by an extruded plate member, said extruded plate member having at least one elongated channel in a surface thereof, said at least one elongated channel having side walls and means in said side walls for threadably receiving a threaded fastener member passing through an end of said back plate, and an elongated rib on said plate member and projecting from said plate, said rib having a groove formed in said rib projection and opening in a direction transverse to the direction of said channel, said groove adapted to receive a flange projecting from an end of said back plate.

2. The invention defined in claim 1 wherein said extruded plate member includes at least a second elongated channel in the same surface thereof as said first channel and parallel thereto, and at least a second groove formed in said rib on the opposite side from the first mentioned groove, said at least a second elongated groove and rib being adapted to mount a second set of solenoid operated, key actuating assemblies in staggered relation to the first named set of solenoid operated key actuating assemblies and in alignment with staggered keys on said keyboard instrument.

3. The invention defined in claim 1 including said mounting brackets and wherein the flanges secured in said ribs, respectively, have a spring locking tongue formed therein.

4. The invention defined in claim 1 including said mounting brackets and wherein the flanges receives in said ribs have a portion initially deflected at a small angle relative to the body thereof so as to apply constant frictional pressure to the rib walls when flush mounted on said extruded plate.

5. The invention defined in claim 4 wherein said threaded fastener member is off-set from the axis of said solenoid.

6. The invention defined in claim 2 wherein said ribs are extruded integral with said plate.

7. The invention defined in claim 1 wherein each of said solenoids includes a plunger, an operating coil, and a low friction bushing inside said operating coil so as to permit said plunger to return freely by gravity to a rest position beneath said keyboard and a stop member for establishing a rest position for the solenoid plunger.

* * * * *